US006142452A

United States Patent [19]

Denman et al.

[11] Patent Number: 6,142,452

[45] Date of Patent: Nov. 7, 2000

[54] HIGHWAY BARRIER AND GUARDRAIL

[75] Inventors: Owen S. Denman, Granite Bay; Patrick A. Leonhardt, Yuba City; Michael H. Oberth, Lincoln; James B. Welch, Placerville; Lincoln C. Cobb, Auburn, all of Calif.

[73] Assignee: Energy Absorption Systems, Inc., Chicago, Ill.

[21] Appl. No.: 09/344,149

[22] Filed: Jun. 24, 1999

Related U.S. Application Data

[62] Division of application No. 08/990,468, Dec. 15, 1997.

[51] Int. Cl.[7] ..... F01F 15/04

[52] U.S. Cl. ..... 256/13.1; 256/1; 404/6

[58] Field of Search ..... 256/13.1, 1; 404/6, 404/9, 10, 11

[56] References Cited

U.S. PATENT DOCUMENTS

| | | |
|---|---|---|
| 1,332,626 | 3/1920 | Henegar . |
| 1,492,561 | 5/1924 | Gabriel . |
| 1,558,364 | 10/1925 | Iverson . |
| 2,047,436 | 7/1936 | Shepherd . |
| 4,838,523 | 6/1989 | Humble et al. . |
| 5,407,298 | 4/1995 | Sicking et al. . |
| 5,503,495 | 4/1996 | Mak et al. . |
| 5,547,309 | 8/1996 | Mak et al. . |
| 5,660,496 | 8/1997 | Muller et al. . |
| 5,765,811 | 6/1998 | Ablerson et al. . |
| 5,821,005 | 12/1998 | Muller et al. . |

FOREIGN PATENT DOCUMENTS

| | | |
|---|---|---|
| 2 282 504 | 3/1976 | France . |
| 2607841 | 6/1988 | France . |
| 89 06721 | 7/1989 | WIPO . |
| 96 20311 | 7/1996 | WIPO . |

OTHER PUBLICATIONS

European Search Report.

*Primary Examiner*—Lynne H. Browne
*Assistant Examiner*—John R. Cottingham
*Attorney, Agent, or Firm*—Brinks Hofer Gilson & Lione

[57] ABSTRACT

A highway guardrail includes an elongated metal plate that forms at least one ridge. The plate includes weakened regions extending at least partially across the plate, and these weakened regions are oriented obliquely to the longitudinal direction to form at least one elongated fold region at which the plate tends to buckle when subjected to a sufficiently large column load. This fold region is oriented obliquely to the longitudinal direction to push the forward end of the guardrail downwardly in an axial collapse. The forward end of the guardrail includes a cable that passes through an opening in the forward support post. A split washer is positioned around this cable adjacent to the forward support post. The split washer includes first and second load transferring members that readily separate from one another after the first support post breaks at the opening in an axial impact.

21 Claims, 5 Drawing Sheets

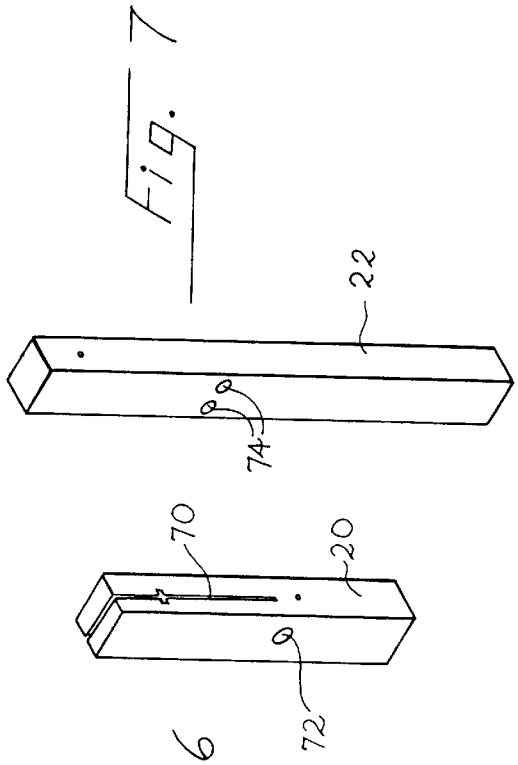
Fig. 7
Fig. 6
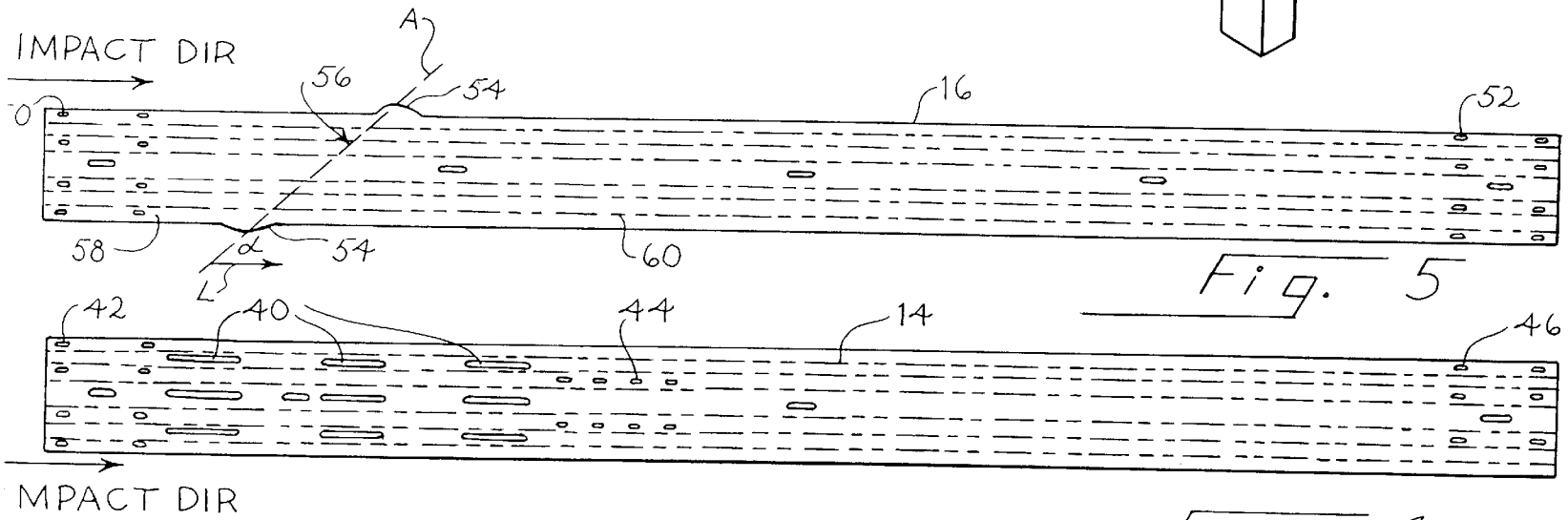
Fig. 5
Fig. 4

HIGHWAY BARRIER AND GUARDRAIL

This application is a division application Ser. No. 09/990,468, filed Dec. 15, 1997.

BACKGROUND OF THE INVENTION

This invention relates to highway barriers that include guardrails extending along side a roadway, and to guardrails suitable for use in such a barrier.

Sicking U.S. Pat. No. 5,407,298 and Mak U.S. Pat. No. 5,547,309 disclose highway barriers including slotted guardrails. The guardrails are conventional steel beams having a W-shape in cross-section. Such a guardrail is well adapted to redirect an automobile after it has left a roadway, but it can provide excessive rigidity against column loads. Such excessive rigidity can result in a tendency of the guardrail to spear an axially impacting vehicle. In order to reduce this tendency, the guardrail disclosed in the Sicking '298 and Mak '309 patents includes longitudinally extending slots that reduce the maximum column load that can be supported by the guardrail.

Mak U.S. Pat. No. 5,503,495 discloses a guardrail cable release mechanism designed for use with a breakaway support post. The cable release mechanism includes a plate that defines a parallel-sided notch and a V-shaped entrance to the notch. This plate is placed between the threaded nut at the end of the barrier cable and the first breakaway support post.

When the breakaway support post is broken in an axial impact, the cable moves out of the notch and V-shaped opening to disengage from the release mechanism.

One potential problem associated with the longitudinally slotted guardrail of the Sicking '298 and Mak '309 patents is that the longitudinal slots separate the guardrail into four parallel ribbons. Because the metal plate between the slots is relatively long and thin, there is little directional control over the direction of bending of the guardrail at the longitudinal slots. This creates the possibility that during an impact the guardrail may fold to an elbow-shape that may be lifted to the height of the windows of the impacting vehicle. If this were to occur, there would be an increased danger that the guardrail might penetrate through the windows into the occupant compartment of the vehicle as it continues to interact with the guardrail installation.

A potential problem associated with the guardrail cable release mechanism of the Mak '495 patent is that the slotted bearing plate might not release as quickly as desired when the breakaway support post is broken in an axial impact, particularly if the support post were to break at an oblique angle to the horizontal.

SUMMARY OF THE INVENTION

The present invention is defined by the following claims, and nothing in this section should be taken as a limitation on those claims.

By way of introduction, the preferred embodiments described below include a highway guardrail that has weakened regions such as slots, holes, thinned regions, crimps or dents that are oriented obliquely to the longitudinal direction of the guardrail. These weakened regions form one or more elongated fold regions at which the guardrail tends to buckle predictably when a sufficiently large column load is applied, as for example, when struck by an axially impacting vehicle. The fold regions are oriented obliquely to the longitudinal direction of the guardrail such that the rearward portion of the guardrail has a reduced tendency to move upwardly as the guardrail buckles.

The guardrail is secured by a tension member (such as a cable) to a support post. First and second load transferring members form a split washer that is interposed between an enlarged portion of the tension member and the support post. These load transferring members extend on opposite sides of the tension member and are positioned to prevent the enlarged portion of the tension member from passing between the load transferring members. The load transferring members readily separate from one another to release the tension member after the support post breaks in an axial impact.

BRIEF DESCRIPTION OF THE DRAWINGS

FIG. 4 is an elevation view of the forwardmost guardrail plate of the embodiment of FIGS. 1 through 3, prior to assembly.

FIG. 5 is an elevation view of the guardrail plate that is disposed immediately rearwardly of the guardrail plate of FIG. 4 in the embodiment of FIGS. 1 through 3, prior to assembly.

FIG. 6 is an isometric view of a support post suitable for use at the forward portion of the embodiment of FIGS. 1 through 3.

FIG. 7 is an isometric view of a support post suitable for use rearwardly of the support post of FIG. 6 in the embodiment of FIGS. 1 through 3.

DETAILED DESCRIPTION OF THE PREFERRED EMBODIMENTS

Figures 1, 8, 9:
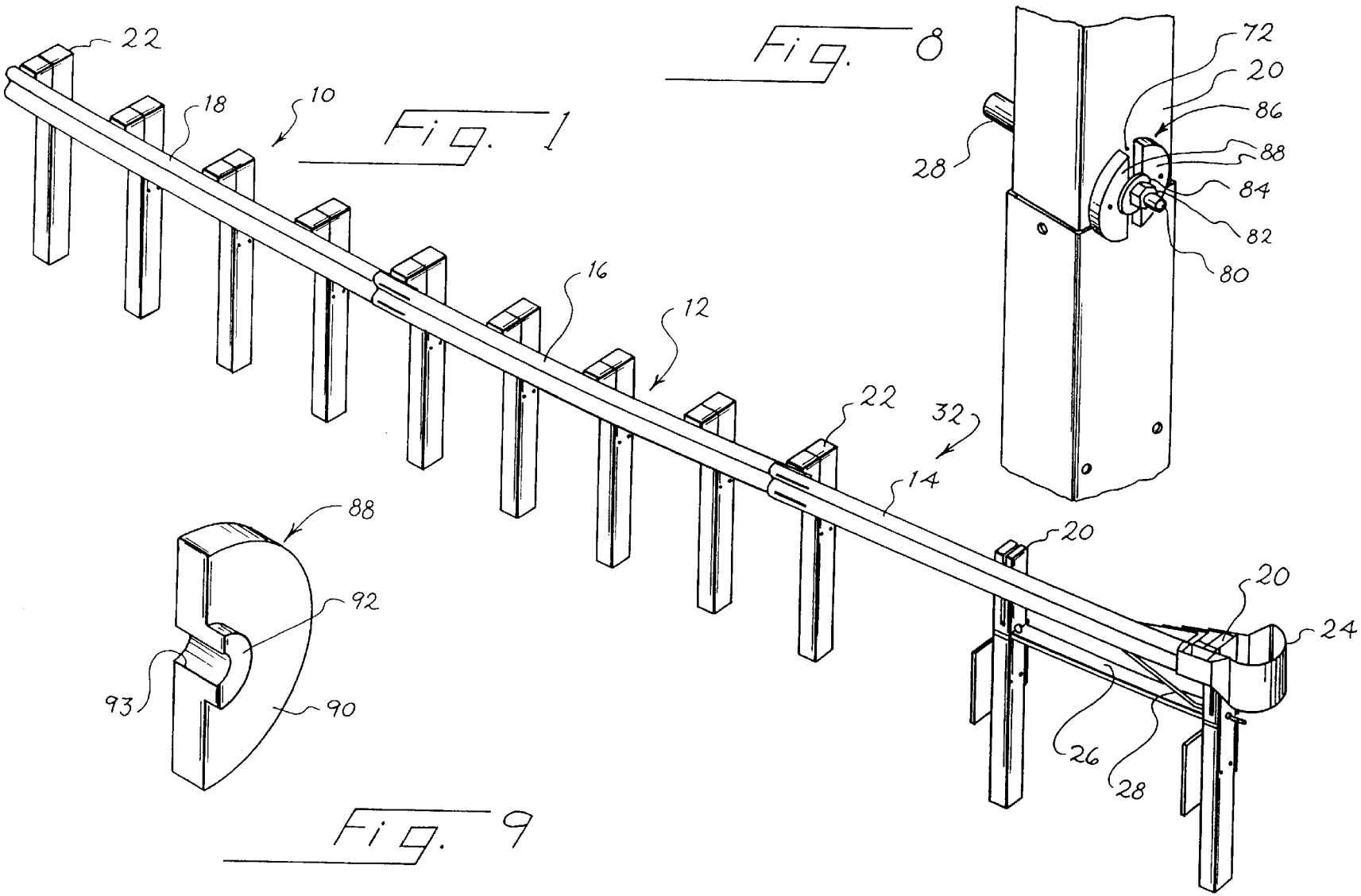
FIGS. 1, 2 and 3 are isometric, elevation and plan views, respectively, of highway barrier that incorporates presently preferred embodiments of the present invention.
FIG. 8 is a fragmentary perspective view showing the forward support post of the embodiment of FIGS. 1 through 3.
FIG. 9 is an isometric view of one of the load transferring members of FIG. 8.
Figure 3:
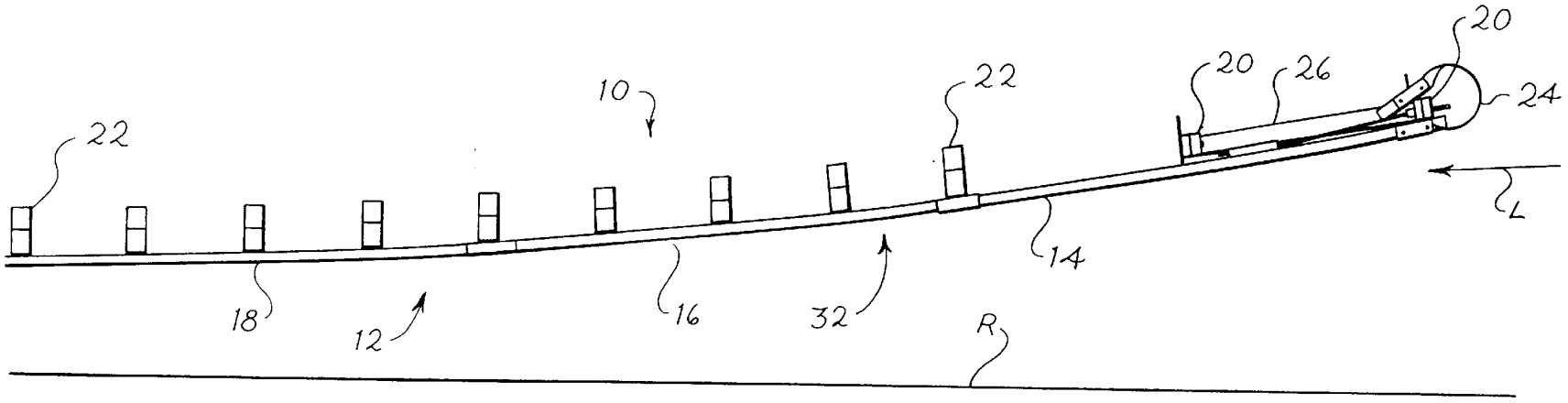
Figure 2:
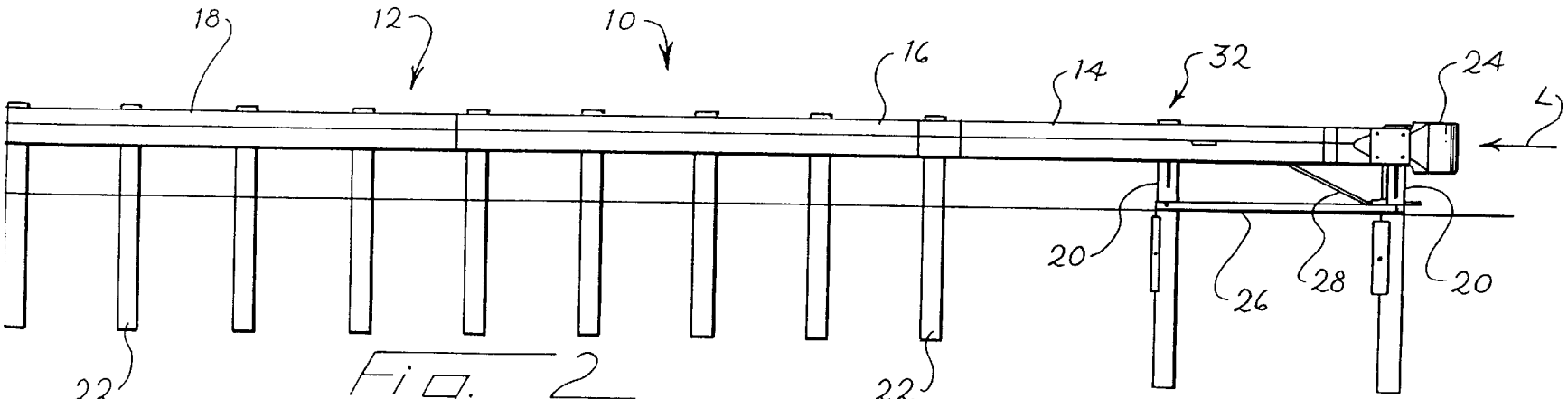

Turning now to the drawings, FIGS. 1 through 3 show various views of a highway barrier 10 that incorporates preferred embodiments of this invention. The barrier 10 includes a guardrail 12 made up of a plurality of guardrail plates 14, 16, and 18. The guardrail plates 14, 16, 18 are sufficiently rigid to deflect an automotive vehicle in many cases. For example, the guardrail plates 14, 16, 18 may be formed of a W-beam of 12-gauge steel, and the W-beam may be shaped as defined in MSHTO specification M18D-89, class A, type 3.

The guardrail 12 is supported above ground level by support posts including front support posts 20 and intermediate support posts 22. As best shown in FIG. 3, the highway barrier 10 is positioned alongside a roadway R, and includes an end section 24 that is buffered to reduce any tendency of the highway barrier 10 to spear an impacting vehicle traveling in the longitudinal direction L. As shown in FIG. 3, the forward section 32 of the highway barrier 10 curves away from the roadway R.

A strut 26 is positioned between the front support posts 20 in the conventional manner. A tension member such as a cable 28 is secured to the guardrail plate 14 between the front support posts 20. The forward end of this cable 28 passes through an opening in the forward support post 20 as described below.

FIG. 4 shows an elevation view of the guardrail plate 14. In FIG. 4, the forward portion of the guardrail plate 14 that supports the end section 24 is positioned to the left. An array of holes 42 is formed in the forward end of the guardrail plate 14 to receive bolts (not shown in FIG. 4) that secure the guardrail plate 14 and the end section 24. Holes 44 are provided for securing an anchor plate (not shown in FIG. 4) that engages the rearward end of the cable 28 (not shown in FIG. 4) in the conventional manner. Rearward holes 46 allow the guardrail plate 14 to be bolted to the guardrail plate 16 of FIGS. 1 through 3. Longitudinally extending slots 40 are provided to weaken the guardrail plate 14 and to dispose it for column buckling when subjected to substantial column loads in an axial impact. In this embodiment, the slots 40 measure approximately 19 by 178 mm, and are centered in the valley and on the ridges of the guardrail plate 14. The slots 40 can be replaced with other means for preventing the plate 14 from spearing an impacting vehicle, such as an array of openings, for example.

FIG. 5 shows an elevation view of the guardrail plate 16. The plate 16 includes forward and rearward holes 50, 52 positioned to receive fasteners that secure the guardrail plate 16 to the guardrail plates 14 and 18, respectively. The guardrail plate 16 also includes weakened regions 54 that form a fold region 56 oriented obliquely with respect to the longitudinal direction L. In the embodiment of FIG. 5, the weakened regions 54 are formed by upsets positioned on the edges of the guardrail plate 16. These upsets are staggered along the length of the guardrail plate 16 and are positioned along a fold axis A that is obliquely oriented at an angle $\alpha$ of about 30° with respect to the longitudinal direction L of the guardrail plate 16. First and second portions 58, 60 of the guardrail plate 16 are positioned forwardly and rearwardly of the fold axis A, respectively. Because the lower weakened region 54 is positioned forwardly of the upper weakened region 54, the second portion 60 tends to move downwardly when the guard rail plate 16 collapses under extreme axial loading associated with an axially impacting vehicle. In this way, the highway barrier 10 is provided with a preferred direction of folding or collapse, which has been designed to maintain the fold region 56 of the guardrail plate 16 near the ground and to assist in controlling the direction of travel of the decelerating impacting vehicle as the highway barrier 10 responds to the impact.

In the embodiment of FIG. 1 the guardrail 12 is secured to the support posts 20, 22 only at the first, fifth and tenth support posts, as counted from the end section 24. The weakened regions 54 are preferably positioned between posts 6 and 7 and optionally between posts 3 and 4.

FIG. 6 shows an isometric view of one of the front support posts 20 suitable for use in the first and second positions of the highway barrier 10.

Each front support post 20 includes a slot 70 and a through-hole 72. In this embodiment, the slot is about 10 mm in width and 610 mm in length, and the hole 72 is about 61 mm in diameter. Each front support post 20 is preferably formed of wood, and the slot 70 is provided to reduce the force required to break the post 20 at the hole 72 in an axial impact.

FIG. 7 shows an isometric view of one of the intermediate support posts 22 that in this embodiment are also made of wood and are used at positions 3 through 11 as counted from the front of the highway barrier 10. Each intermediate support post 22 includes two holes 74 that are about 51 mm in diameter.

FIGS. 8 and 9 provide further details regarding the manner in which the forward end of the cable 28 is secured to the first front support post 20.

As shown in FIG. 8, the forward end of the cable 28 includes a threaded end 80 that receives a nut 82 and a washer 84. The nut 82 and the washer 84 cooperate to form an enlarged portion of the cable 28 having a first area. In alternative embodiments, the enlarged portion can be swaged or otherwise permanently formed on or releasably secured to the end of the cable 28. A split washer 86 is interposed between the washer 84 and the post 20. This split washer 86 is formed of two load transferring members 88 that have a combined cross-sectional area adjacent to the post 20 that is greater than the first area of the washer 84. Thus, the load transferring members 88 perform a load-spreading function.

As best shown in FIG. 9, each of the load transferring members 88 includes a first part 90 that lies alongside the post 20 and a second part 92 dimensioned to fit into the hole 72 (FIG. 8). The first and second parts 90, 92 preferably define a notch 93 to partially receive the cable. As shown in FIG. 8, each of the load transferring members is positioned entirely on a respective side of a vertical plane passing through the center of the cable 28, and the gap between the load transferring members 88 is preferably oriented vertically.

In a sufficiently severe axial impact, the impacting vehicle will break the support post 20 at the hole 72. This will allow the load transferring members 88 to move away from one another, thereby releasing the threaded end 80 of the cable 28, including the nut 82 and the washer 84.

The weakened regions described above can take many alternative forms, as shown in FIGS. 10 through 14. Each of these figures shows an isometric view of an alternative form of the guard rail plate 16, and in each case the fold axis is indicated by the reference symbol A. In FIGS. 10–14, the front of the guardrail plate 16 is to the left, and the weakened regions are near the front end of the plate 16.

Figure 10:
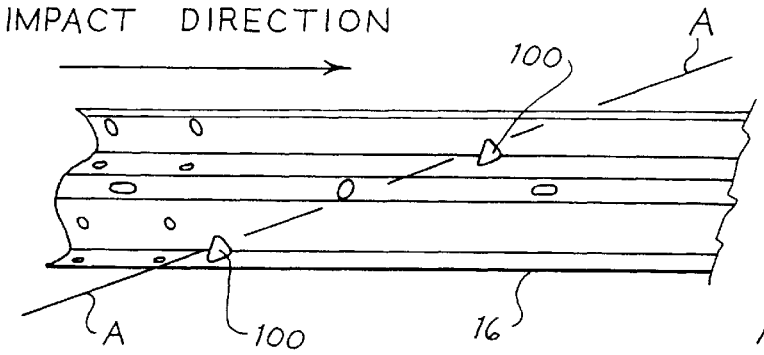
FIGS. 10 through 14 are isometric views of alternative embodiments of weakened regions suitable for defining a fold region in guardrail panels of alternative embodiments.

In the embodiment of FIG. 10, the weakened regions are formed by circular holes 100. Because the circular holes 100 are formed on the uppermost portion of the ridges and the lowermost portion of the central valley, they do not appear colinear in the isometric view of FIG. 10, but they would appear colinear in elevation.

Figure 11:
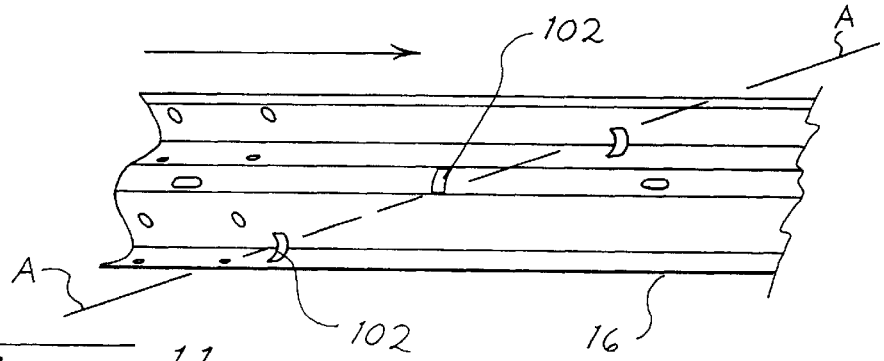
Figure 12:
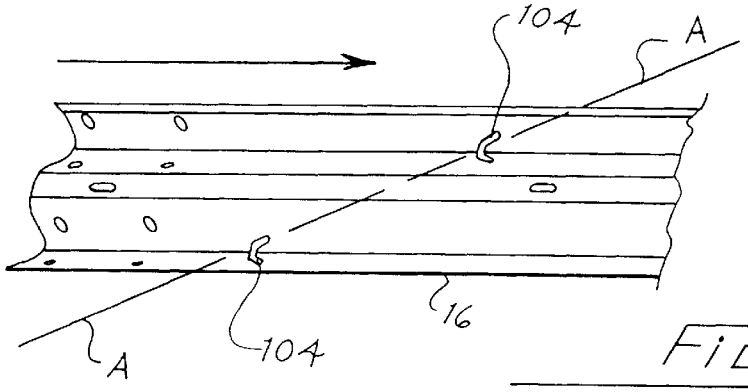
Figure 13:
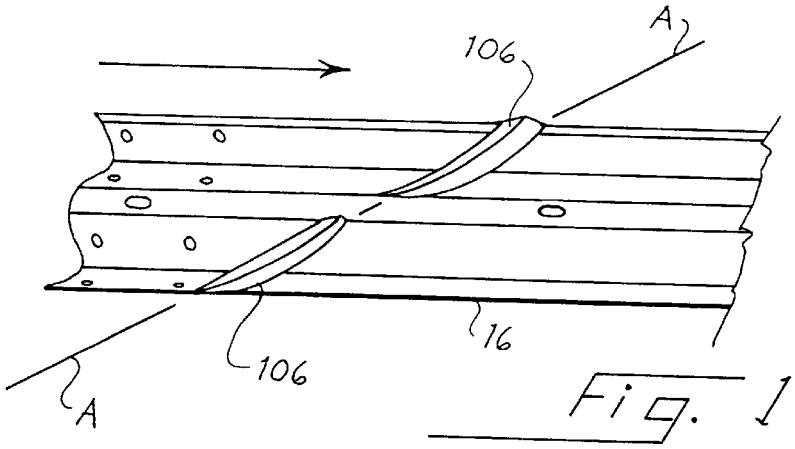
Figure 14:
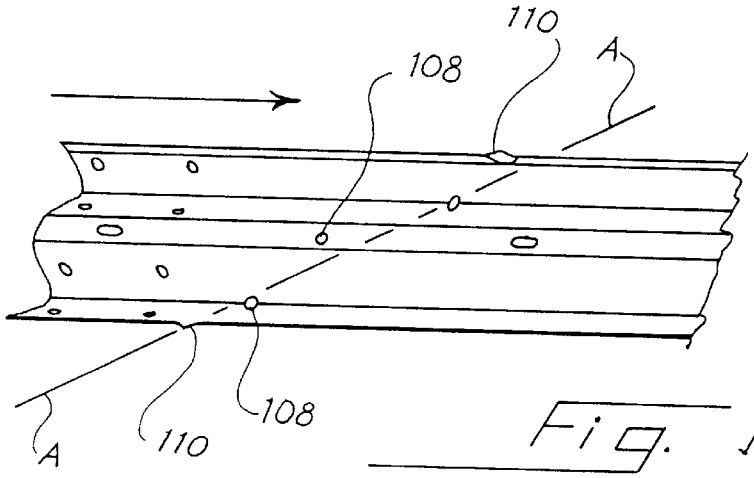

In the embodiments of FIGS. 11 and 12 the weakened regions are formed by slots 102, and non-circular holes 104, respectively. As shown in FIG. 13, the weakened regions may be formed by one or more crimps 106, and in FIG. 14 the weakened regions are formed by a combination if holes 108 and crimps 110. In alternative embodiments the weakened regions may correspond to thinned regions of the guardrail plate.

Many changes and modifications can be made to the preferred embodiments described above. For example, this invention is not limited to use with W-beams that define two ridges extending longitudinally of the beam. Rather, this invention can be adapted for use with the widest variety of guard rail plates, including those having one, two, three or more longitudinally extending ridges, as well as box sections. The tension member is not limited to the cable form illustrated above; rather any suitable structure for transmitting tensile loads, including metal straps, rods, chains and the like can be used. The load transferring members may be shaped differently than illustrated, and the second part 92 may extend more deeply into the opening 72. If desired, notches 93 can be eliminated in the first and second parts 90, 92. The posts can be formed of any suitable material. The fold region does not have to be shaped as a straight line and it can be positioned and shaped as appropriate for the particular application. The fold region can be defined from dissimilar weakened regions. For example, a fold region can be defined by the combination of a circular hole, a non-circular hole, and a crimp. In alternative applications, the weakened regions may extend partially or completely across the guardrail panel. The weakened regions may be oriented at other oblique (non-perpendicular) directions with respect to the longitudinal direction, such as 45° for example.

Figure 15:
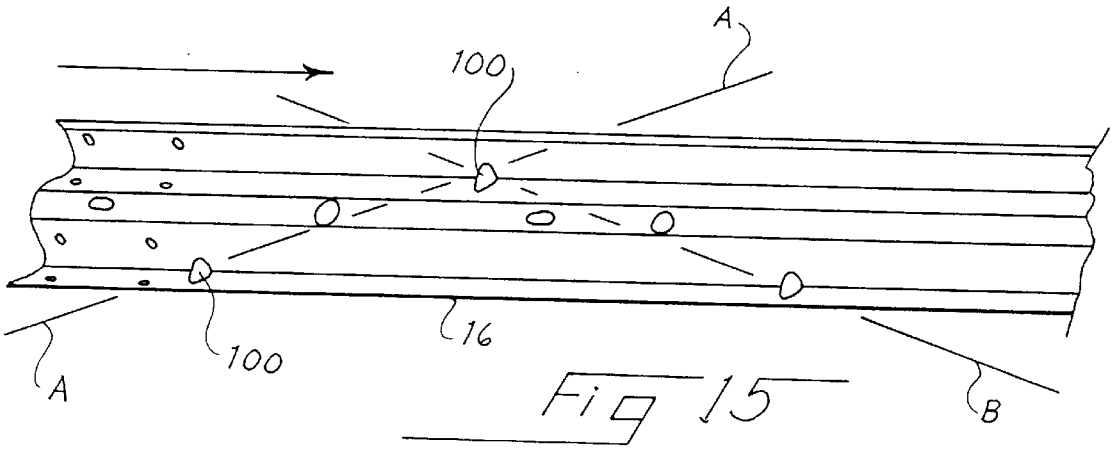
FIG. 15 is an isometric view of a guardrail panel including weakened regions for defining two fold regions.

A plurality of weakened regions may also be employed to provide controlled folding of the guardrail plate. For example, FIG. 15 shows a view of a guardrail plate 16 on which two fold axes, A and B, are defined by perforations in the guardrail plate aligned along the fold axes when viewed in elevation. By appropriately positioning one or more fold regions, and through the adjustment of the angles of the thus created fold axes, the timing and magnitude of the folding response of the guardrail plate may be adjusted for particular applications along the roadway.

The guardrail plates described above can be used in a wide variety of barriers, including simple guardrail barriers, converging guardrail barriers, and energy absorbing barriers. Though shown in use at a forward portion of a guardrail barrier, these guardrail plates can be used at any desired point along the length of the guardrail barrier. Similarly, the load transferring members can be used at other support posts than the forwardmost post illustrated.

As used herein, the term "set" of elements is intended broadly to encompass one or more elements.

The foregoing detailed description has described only a few of the many forms that this invention can take. For this reason, it is intended that this detailed description be regarded as illustrative and not as limiting. It is only the following claims, including all equivalents, that are intended to define the scope of this invention.

We claim:

1. A highway guardrail comprising an elongated metal beam, said beam deining a longitudinal direction and a beam width measured transverse to the logitudinal direction, said beam comprising two edges extending along the longitudinal direction and at least one ridge extending substantially parallel to the longitudinal direction and located substantially inwardly of the edges, each ridge comprising a peak that forms a ridge line extending substantially parallel to the longitudinal direction throughout a length along the longitudinal direction that is substantially greater than said beam width, said beam having a rigidity adapted to deflect an automobile that has left a roadway and comprising a set of weakened regions extending at least partially across the beam, said weakened regions oriented obliquely to the longitudinal direction to form an elongated fold region at which the beam tends to buckle when subjected to a sufficiently large column load, said folding region providing a preferred direction of folding for the guardrail in an axial impact, said fold region oriented obliquely to thee longitudinal direction and operative to reduce any tendency of a rearward portion of the guardrail to move upwardly as the guardrail buckles.

2. The invention of claim 1 wherein the weakened regions are operative to cause a portion of the beam positioned rearwardly of the fold region to move downwardly when the beam collapses in an axial impact.

3. The invention of claim 1 wherein the weakened regions comprise at least one opening in the beam.

4. The invention of claim 1 wherein the weakened regions comprise at least one thinned region in the beam.

5. The invention of claim 1 wherein the weakened regions comprise at least one dented region in the beam.

6. The invention of claim 1 wherein the beam forms two parallel ridges.

7. A highway barrier comprising the guardrail of claim 1 wherein said guardrail is oriented in the highway barrier such that a first portion of the beam is situated forward of a second portion of the beam in an anticipated direction of an axial impact, wherein the fold region is between the first and second portions of the beam, and wherein the fold region is oriented to reduce any tendency of the fold region to lift when the beam folds along the fold region in the axial impact.

8. The highway barrier of claim 7 wherein the highway barrier comprises a forward section, and wherein the forward section comprises the guardrail of claim 1.

9. The invention of claim 1 wherein the fold region is oriented at an angle of about 30° with respect to the longitudinal direction.

10. The invention of claim 1 wherein the fold region is oriented at an angle greater than about 10° with respect to the longitudinal direction.

11. The invention of claim 1 wherein the fold region is oriented at an angle greater than about 20° with respect to the longitudinal direction.

12. The invention of claim 1 wherein the fold region is oriented at an angle greater than about 30° with respect to the longitudinal direction.

13. The invention of claim 1 wherein the beam preferentially tends to buckle at the elongated fold region when subjected to a sufficiently large column head.

14. A highway guardrail comprising an elongated metal beam, said beam defining a longitudinal direction and a beam width measured tansverse to the longitudinal direction, said beam comprising two edges extending along the longitudinal direction and at least one ridge extending substantially parallel to the longitudinal direction and located substantially inwardly of the edges, each ridge omprising a peak that forms a ridge line extneding substantially parallel to the longitudinal direction throughout a length along the longitudinal direction that is substantially greater than said beam width, said beam having a rigidity adapted to deflect an automobile that has left a roadway and comprising a set of weakened regions extending at least partially across the beam, said weakened regions oriented obliquely to the longitudinal direction to form an elongated fold region at which the beam is predisposed to buckle when subjected to a sufficiently large column load, said folding region providing a preferred direction of folding for the guardrail in an axial impact, said fold region oriented obliquely to the longitudinal direction and operative to reduce any tendency of a rearward portion of the guardrail to move upwardly as the guardrail buckles.

15. A highway guardrail comprising an elongated metal beam, said beam defining a longitudinal direction and a beam width measured tansverse to the longitudinal direction, said beam comrising two edges extending along the longitudinal direction and at least one ridge extending substantially parallel to the longitudinal direction and located substantially inwardly of the edges, each ridge comprising a peak that forms a ridge line extending substantially parallel to the longitudinal direction throughout a length along the longitudinal direction that is substantially greater than said beam width, said beam having a rigidity adapted to deflect an automobile that has left a roadway and comprising means for reducing any tendency of a rearward portion of the guardrail to move upwardly as the guardrail buckles, said means comprising a set of weakened regions extending at least partially across the beam, said weakened regions oriented obliquely to the longitudinal direction to form an elongated fold region oriented obliquely to the longitudinal direction, at which fold region the beam tends to buckle when subjected to a sufficiently large column load, said folding region providing a preferred direction of folding for the guardrail in an axial impact.

16. A highway guardrail comprising an elongated metal beam, said beam defining a longitudinal direction and a beam width measured transverse to the longitudinal direction, said beam comprising two edges extending along the longitudinal direction and at least one ridge extending substantially parallel to the longitudinal direction and located substantially inwardly of the edges, each ridge comprising a peak that forms a ridge line extending substantially parallel to the longitudinal direction throughout a length along the longitudinal direction that is substantially greater than said beam width, said beam having a rigidity adapted to deflect an automobile that has left a roadway and comprising means for reducing any tendency of a rearward portion of the guardrail to move upwardly as the guardrail buckles, said means comprising at least two sets of weakened regions, each set extending at least partially across the beam, said weakened regions in each set oriented obliquely to the longitudinal direction to form a plurality of elongated fold regions oriented obliquely to the longitudinal direction, at which fold regions the beam preferentially tends to buckle when subjected to a sufficiently large column load, said folding regions providing preferred directions of folding for the guardrail in an axial impact, said fold regions oriented obliquely to the longitudinal direction.

17. A highway guardrail comprising an elongated metal beam, said beam defining a longitudinal direction and a beam width measured transverse to the longitudinal direction, said beam comprising two edges extending along the longitudinal direction and at least one ridge extending substantially parallel to the longitudinal direction and located substantially inwardly of the edges, each ridge comprising a peak that forms a ridge line extending substantially parallel to the longitudinal direction throughout a length along the longitudinal direction that is substantially greater than said beam width, said beam having a rigidity adapted to deflect an automobile that has left a roadway and comprising a set of weakened regions extending at least partially across the beam, said weakened regions oriented obliquely to the longitudinal direction to form an elongated fold region at which the beam tends to buckle when subjected to a sufficiently large column load, wherein the beam comprises a segment extending along the longitudinal dimension and comprising the fold region, and wherein the weakened regions in the segment are spatially concentrated in the fold region.

18. A highway guardrail comprising an elongated metal beam, said beam defining a longitudinal direction and a beam width measured tansverse to the longitudinal direction, said beam comprising two edges extending along the longitudinal direction and at least one ridge extending substantially parallel to the longitudinal direction and located substantially inwardly of the edges, each ridge comprising a peak that forms a ridge line extending substantially parallel to the longitudinal direction throughout a length along the longitudinal direction that is substantially greater than said beam width, said beam having a rigidity adapted to deflect an automobile that has left a roadway and comprising at least two sets of weakened regions, each set extending at least partially across the beam, said weakened regions in each set oriented obliquely to the longitudinal direction to form a plurality of elongated fold regions at which the beam tends to buckle when subjected to a sufficiently large column load, wherein the beam comprises a segment extending along the longitudinal dimension and comprising the fold regions, and wherein the weakened regions in the segment are spatially concentrated in the fold regions.

19. The invention of claim 1, 14, 15, 16, 17 or 18, wherein the beam is substantially constant in section transverse to the longitudinal direction throughout the length.

20. The invention of claim 1, 14, 15, 16, 17 or 18, wherein the at least one ridge comprises at least two parallel ridges, and wherein a cross-section of the beam at any point along the length passses through the peaks of said at least two parallel ridges.

21. The invention of claim 1, 14, 15, 16, 17 or 18, wherein each ridge is formed as an integral aspect of the beam.

* * * * *

UNITED STATES PATENT AND TRADEMARK OFFICE

CERTIFICATE OF CORRECTION

PATENT NO. : 6,142,452
DATED : November 7, 2000
INVENTOR(S) : Owen S. Denman et al.

It is certified that error appears in the above-identified patent and that said Letters Patent is hereby corrected as shown below:

Claim 1,
Line 2, change "deining" to -- defining --.
Line 19, change "thee" to -- the --.

Claim 7,
Line 1, change "claim 1" to -- claim 1, --.

Claim 14,
Line 8, change "extneding" to -- extending --.

Claim 15,
Line 4, change "comrising" to -- comprising --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*